US006941084B2

(12) United States Patent
Hamby et al.

(10) Patent No.: US 6,941,084 B2
(45) Date of Patent: Sep. 6, 2005

(54) COMPENSATING OPTICAL MEASUREMENTS OF TONER CONCENTRATION FOR TONER IMPACTION

(75) Inventors: Eric S. Hamby, Fairport, NY (US); R. Enrique Viturro, Rochester, NY (US); Eric M. Gross, Rochester, NY (US); Douglas A. Kreckel, Webster, NY (US)

(73) Assignee: Xerox Corporation, Stamford, CT (US)

( * ) Notice: Subject to any disclaimer, the term of this patent is extended or adjusted under 35 U.S.C. 154(b) by 110 days.

(21) Appl. No.: 10/607,290

(22) Filed: Jun. 26, 2003

(65) Prior Publication Data

US 2004/0264985 A1 Dec. 30, 2004

(51) Int. Cl.[7] ..... G03G 15/08
(52) U.S. Cl. ..... 399/64
(58) Field of Search ..... 399/27–30, 61, 399/62, 64, 65; 118/691

(56) References Cited

U.S. PATENT DOCUMENTS 4,155,638 A * 5/1979 Blitzer ..... 399/59
4,980,727 A * 12/1990 Stelter ..... 399/64
4,989,985 A 2/1991 Hubble, III et al. ..... 356/445
5,519,497 A 5/1996 Hubble, III et al. ..... 356/445
6,118,953 A * 9/2000 Hockey et al. ..... 399/59
6,160,971 A * 12/2000 Scheuer et al. ..... 399/58
6,606,463 B2 8/2003 Gross et al.
2004/0146796 A1 7/2004 Gross et al. ..... 430/111.1

OTHER PUBLICATIONS

Copending U.S. Appl. No. 10/607,212, filed concurrently herewith, entitled "LED Color Specific Optical Toner Concentration Sensor," by R. Enrique Viturro et al.

* cited by examiner

*Primary Examiner*—Robert Beatty
(74) *Attorney, Agent, or Firm*—Lloyd F. Bean, II

(57) ABSTRACT

A method for sensing toner concentration in a developer housing with an optical system containing developer material including toner and carrier, the method, including: emitting light with the optical system through a viewing window in the developer housing onto developer material in the housing; sensing the light reflected off the developer material with the optical system; calculating a toner concentration measurement based upon the sensed light reflected off the developer material; and compensating the toner concentration measurement to account for optical variation due to the developer material condition.

13 Claims, 6 Drawing Sheets

COMPENSATING OPTICAL MEASUREMENTS OF TONER CONCENTRATION FOR TONER IMPACTION

CROSS-REFERENCE TO RELATED APPLICATION

Reference is made to commonly-assigned copending U.S. No. 20040264983, filed concurrently, entitled "LED Color Specific Optical Toner Concentration Sensor," by R. Enrique Viturro et al., the disclosure of which is incorporated herein.

This invention relates generally to a printing machine, and more particularly concerns an apparatus for controlling the concentration of toner in a development system of an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductive member is cleaned by a cleaning device.

In a machine of the foregoing type, it is desirable to regulate the addition of toner particles to the developer material in order to ultimately control the triboelectric characteristics (tribo) of the developer material. However, control of the triboelectric characteristics of the developer material are generally considered to be a function of the toner concentration within the developer material. Therefore, for practical purposes, machines of the foregoing type usually attempt to control the concentration of toner particles in the developer material.

Toner tribo is an important "critical parameter" for development and transfer. Constant tribo would be an ideal case. Unfortunately, it varies with time and environmental changes. Since tribo is almost inversely proportional to Toner Concentration (TC) in a two component developer system, the tribo variation can be compensated for by the control of the toner concentration.

Toner Concentration is conventionally measured by a Toner Concentration (TC) sensor. The problems with TC sensors are that they are expensive, not very accurate, and rely on an indirect measurement technique which has poor signal to noise ratio.

Currently, the requirement for toner concentration (TC) sensing accuracy on high-end digital color printers is ±0.750% TC (3σ). This requirement is due to "reload" and "toner spitting" latitude boundaries. Due to ongoing design changes and an improved understanding of long term system behavior, this requirement may need to be tightened to ±0.5% TC (3σ). To sense TC, a magnetic sensor approach is used, which infers TC from measurements of the magnetic permeability of the developer. A potential problem is that this approach appears to be accurate to within ±1.1% TC. Moreover, the likelihood of improving the accuracy of this approach beyond ±1.0% TC seems to be extremely small. Hence, achieving program system performance targets under a magnetic-based TC sensing approach does not appear probable.

Optical approaches to TC sensing have shown promise of meeting a more stringent (±0.5% TC (3σ)) TC sensing accuracy requirement. This approach uses the fact that the color of the developer changes as a function of TC to infer the level of TC in a housing. Because this approach infers TC from color changes in the developer, any noise factors that cause the color of the developer to change will be interpreted as changes in TC, even if the TC in the housing is constant. In particular, optical TC sensing experiments have shown that the level of toner impaction on the carrier is a primary noise factor leading to TC sensing errors (±0.35% TC). Compensating optical TC measurements for the effect of impaction would help enable this approach to meet more stringent TC sensing requirements.

There is provided a method for sensing toner concentration in a developer housing with an optical system containing developer material including toner and carrier, the method, including: emitting light with the optical system through a viewing window in the developer housing onto developer material in the housing; sensing the light reflected off the developer material with the optical system; calculating a toner concentration measurement based upon the sensed light reflected off the developer material; and compensating the toner concentration measurement to account for optical variation due to the developer material condition.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
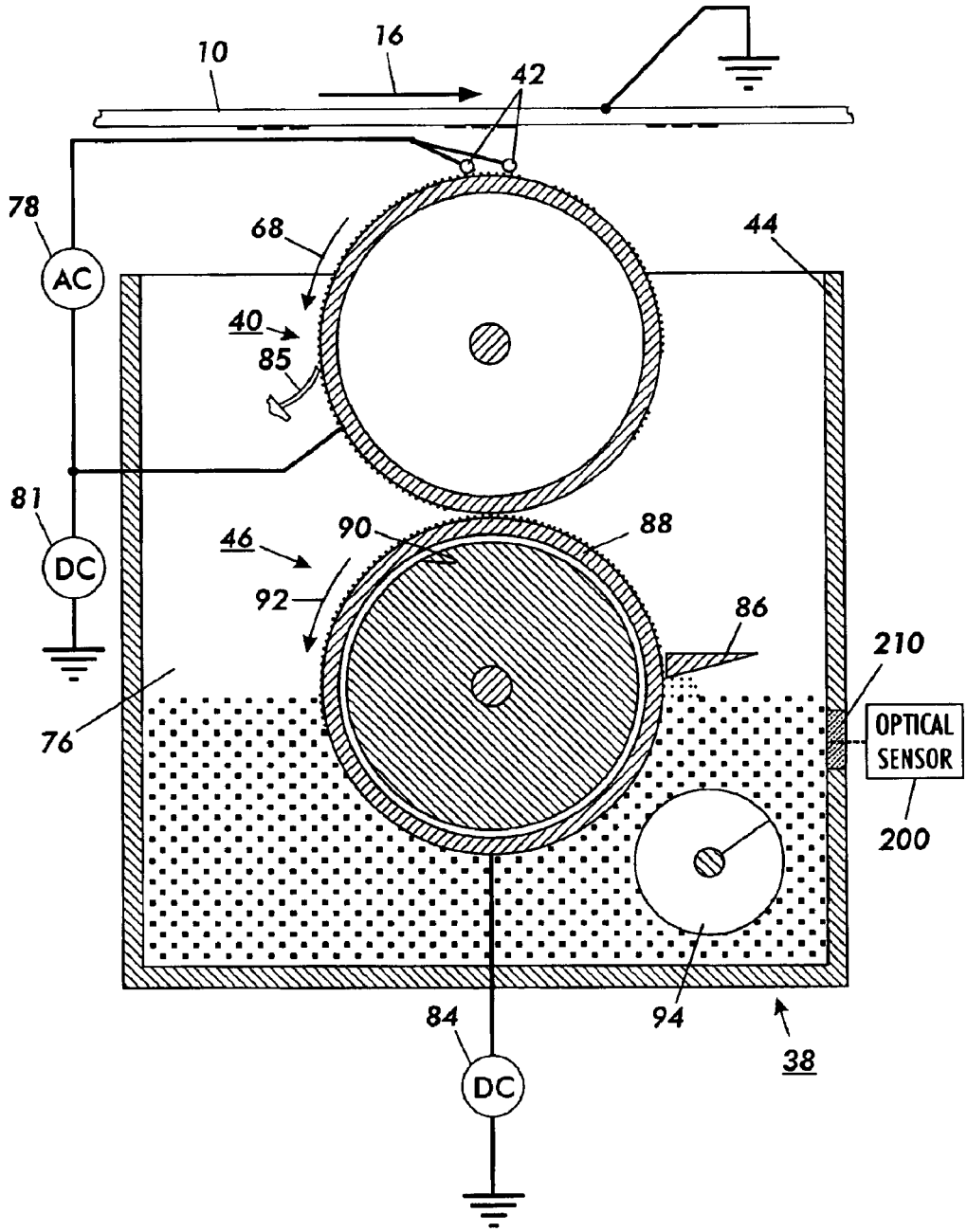
FIG. 1 is a schematic elevational view of a typical electrophotographic printing machine utilizing the toner maintenance system therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the toner control apparatus of the present invention may be employed in a wide variety of devices and is not specifically limited in its application to the particular embodiment depicted herein.

Referring to FIG. 1, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage $V_0$, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or background areas.

At a first development station C, developer structure, indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles 426 to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 100 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles 440. Further, a toner concentration sensor 100 senses the toner concentration in the developer housing structure 442.

Figure 4:
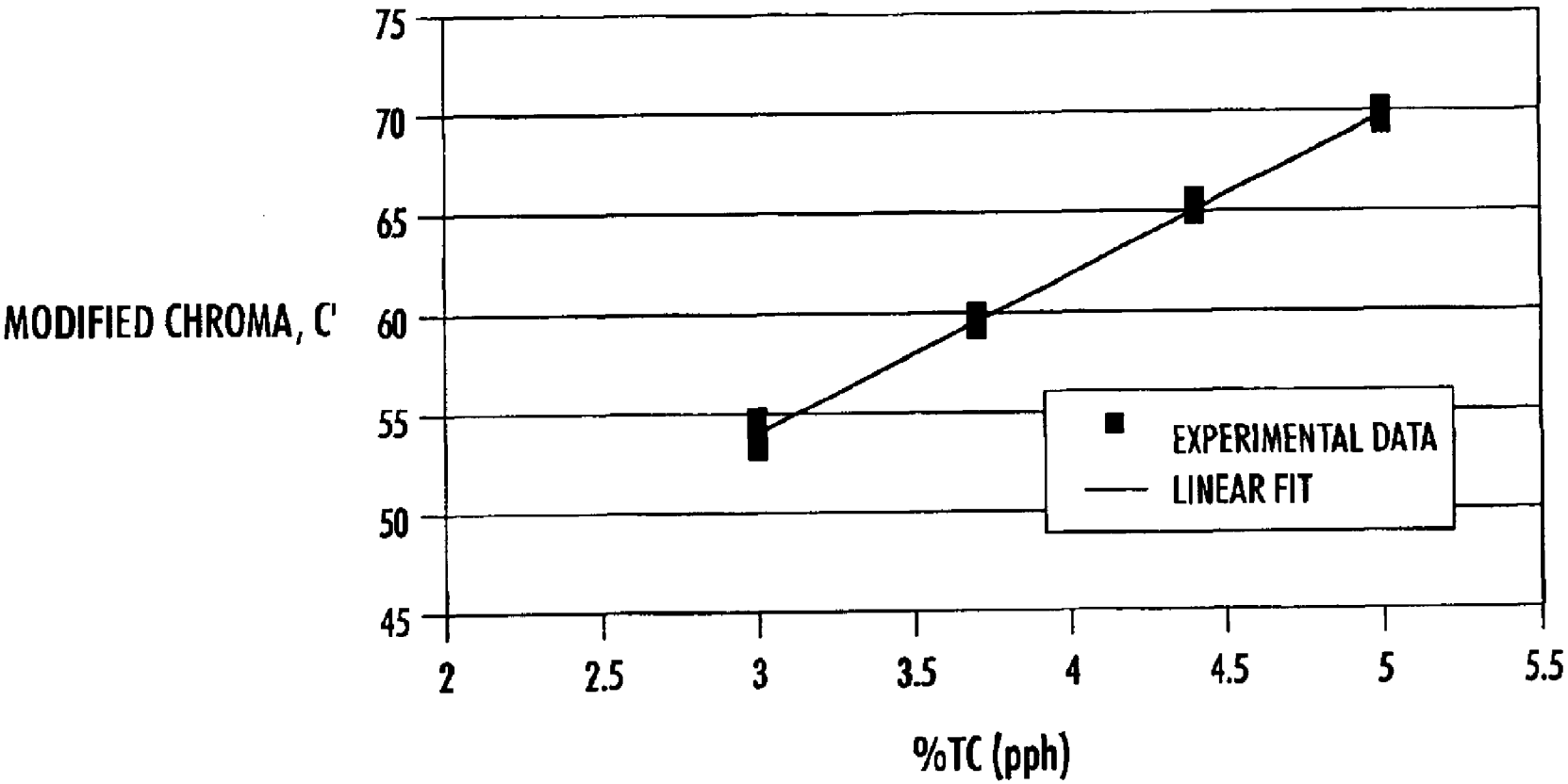
FIG. 4 illustrates a typical response of the optical sensor to changes in TC.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 4, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor (not shown) which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brush 468 or brushes 468 are engaged after the composite toner image is transferred to a sheet. Once the photoreceptor belt 410 is cleaned the brushes 468 are retracted utilizing a device incorporating a clutch (not shown) so that the next imaging and development cycle can begin.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

Figure 2:
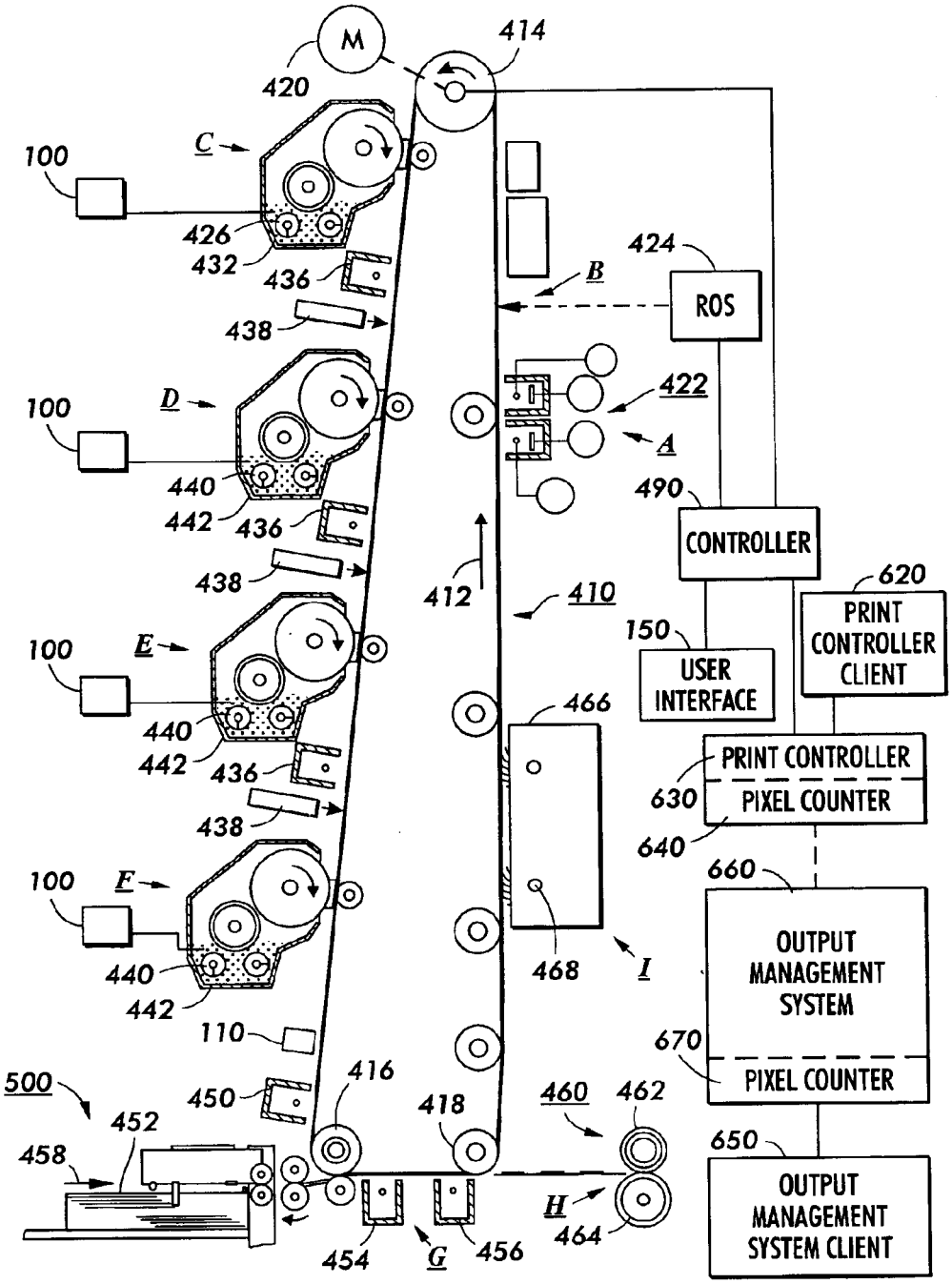
FIG. 2 is a schematic elevational view of the development system utilizing the invention therein.

Now referring to the developer station, for simplicity one developer station will be described in detail, since each developer station is substantially identical. In FIG. 2, donor roller 40 is shown rotating in the direction of arrow 68, i.e. the 'against' direction. Similarly, the magnetic roller 46 can be rotated in either the 'with' or 'against' direction relative to the direction of motion of donor roller 40. In FIG. 2, magnetic roller 46 is shown rotating in the direction of arrow 92, i.e. the 'with' direction. Developer unit 38 also has electrode wires 42 which are disposed in the space between the photoconductive belt 10 and donor roller 40. A pair of electrode wires 42 are shown extending in a direction substantially parallel to the longitudinal axis of the donor roller 40. The electrode wires 42 are made from one or more thin (i.e. 50 to 100$\mu$ diameter) wires (e.g. made of stainless steel or tungsten) which are closely spaced from donor roller 40. The distance between the electrode wires 42 and the donor roller 40 is approximately 25$\mu$ or the thickness of the toner layer on the donor roller 40. The electrode wires 42 are self-spaced from the donor roller 40 by the thickness of the toner on the donor roller 40. To this end the extremities of the electrode wires 42 supported by the tops of end bearing blocks also support the donor roller 40 for rotation. The ends of the electrode wires 42 are now precisely positioned between 10 and 30 microns above a tangent to the surface of donor roller 40.

With continued reference to FIG. 2, an alternating electrical bias is applied to the electrode wires 42 by an AC voltage source 78. The applied AC establishes an alternating electrostatic field between the electrode wires 42 and the donor roller 40 which is effective in detaching toner from the surface of the donor roller 40 and forming a toner cloud about the wires, the height of the cloud being such as not to be substantially in contact with the photoconductive belt 10. The magnitude of the AC voltage is on the order of 200 to 500 volts peak at a frequency ranging from about 3 kHz to about 10 kHz. A DC bias supply 81 which applies approximately 300 volts to donor roller 40 establishes an electrostatic field between photoconductive surface of belt 10 and donor roller 40 for attracting the detached toner particles from the cloud surrounding the electrode wires 42 to the latent image recorded on the photoconductive surface 12. At a spacing ranging from about 10$\mu$ to about 40$\mu$ between the electrode wires 42 and donor roller 40, an applied voltage of 200 to 500 volts produces a relatively large electrostatic field without risk of air breakdown. The use of a dielectric coating on either the electrode wires 42 or donor roller 40 helps to prevent shorting of the applied AC voltage.

Magnetic roller 46 meters a constant quantity of toner having a substantially constant charge onto donor roller 40. This insures that the donor roller provides a constant amount of toner having a substantially constant charge as maintained by the present invention in the development gap.

A DC bias supply 84 which applies approximately 100 volts to magnetic roller 46 establishes an electrostatic field between magnetic roller 46 and donor roller 40 so that an electrostatic field is established between the donor roller 40 and the magnetic roller 46 which causes toner particles to be attracted from the magnetic roller 46 to the donor roller 40.

An optical sensor 200 is positioned adjacent to transparent viewing window 210 which is in visual communication with housing 44. Preferably, transparent viewing window 210 is positioned in a place where the developer material is well mixed near an auger supplying the magnetic roller 46 thereby a toner concentration representative of the overall housing 44 can be obtained.

The optical sensor 200 is positioned adjacent the surface of transparent viewing window 210. The toner on transparent viewing window 210 is illuminated. The optical sensor 200 generates proportional electrical signals in response to electromagnetic energy, reflected off of the transparent viewing window 210 and toner on transparent viewing window 210, is received by the optical sensor 200. In response to the signals, the amount of toner concentration can be calculated.

The optical sensor 200 detects specular and diffuse electromagnetic energy reflected off developer material on transparent viewing window 210. Preferably the optical sensor 200 is a type employed in an Extended Toner Area Coverage Sensor (ETACS) Infrared Densitometer (IRD) such as an Optimized Color Densitometers (OCD), which measures material density located on a substrate by detecting and analyzing both specular and diffuse electromagnetic energy signal reflected off of the density of material located on the substrate as described in U.S. Pat. Nos. 4,989,985 and 5,519,497, which is hereby incorporated by reference. The optical sensor 200 is positioned adjacent the surface of transparent viewing window 210. The toner on transparent viewing window 210 is illuminated. The optical sensor 200 generates proportional electrical signals in response to electromagnetic energy, reflected off of the transparent viewing window 210 and developer material on transparent viewing window 210, is received by the optical sensor 200. In response to the signals, the amount of toner concentration can be calculated by controller 215.

Preferably, the present invention employs an optical approach that infers the % TC level in the developer housings by using the fact that there are particular regions of the optical spectra of each CMYK developer which show the larger changes as a function of % TC, therefore, by illuminating the developers with specific color lights matched to those regions one can achieve both increase responsively to % TC changes per unit energy input, while maintaining simplicity in the device and dramatic cost reductions, as disclosed in U.S. Publication No. 20040264983, which is hereby incorporated by reference.

It has been found that the LED excitation sources have peak wavelengths in the range 400–500 nm or 750–850 nm for cyan, 500–800 nm for yellow, 600–800 nm for magenta, and 800–1000 nm for black, providing the highest responsively for each developer housing.

It has been found that TC can determine the response of the proposed optical % TC sensor as follows:

$$\%\,TC_i = C_i \times \int_{\lambda_0}^{\lambda_1} R_{PD} E_i R_i d\lambda \tag{1}$$

Where i=C, M, Y, K $R_{PD}$ is the normalized spectral responsively of the photodiode.

Ei is the normalized spectral density of the i LED.

Ci is a constant containing (a) optical path factors, (b) peak responsivity of the photodiode, (c) peak responsivity of the LED, (d) conversion factor from reflectivity to % TC, etc. These factors can be optimized according to S/N ratio, device cost, etc. $R_{PD}$ is the normalized spectral responsively of the photodiode.

Then, for each particular developer and LED emitter set the equation can be reduced to:

$$\%\,TC = K_i \times V_i$$

Where the Ki is a constant containing all the parameters for the particular set, and Vi is the voltage reading from the photodiode.

Now focusing on a method of improving optical TC measurement accuracy by compensating for impaction effects using an open-loop, exponential correction factor. Roughly speaking, the correction algorithm estimates the level of impaction in a developer housing using a model that is exponential in carrier age (see Eq. (4)). The correction term applied to the measured TC at each sample time is then taken to be linear in the estimated level of impaction (see Eq.(3)). Experimental data suggests that impaction-based TC sensing errors are on the order of ±0.35% TC. The correction algorithm proposed here reduces the effect of impaction to ±0.15% TC, which represents more than a factor of 2 improvement in TC sensing errors due to impaction.

The impaction correction algorithm given here is similar in spirit to the "developer material break-in", "toner age", and, to a lesser extent, the "temperature" correction algorithms currently used to adjust magnetic TC measurement.

Figure 3:
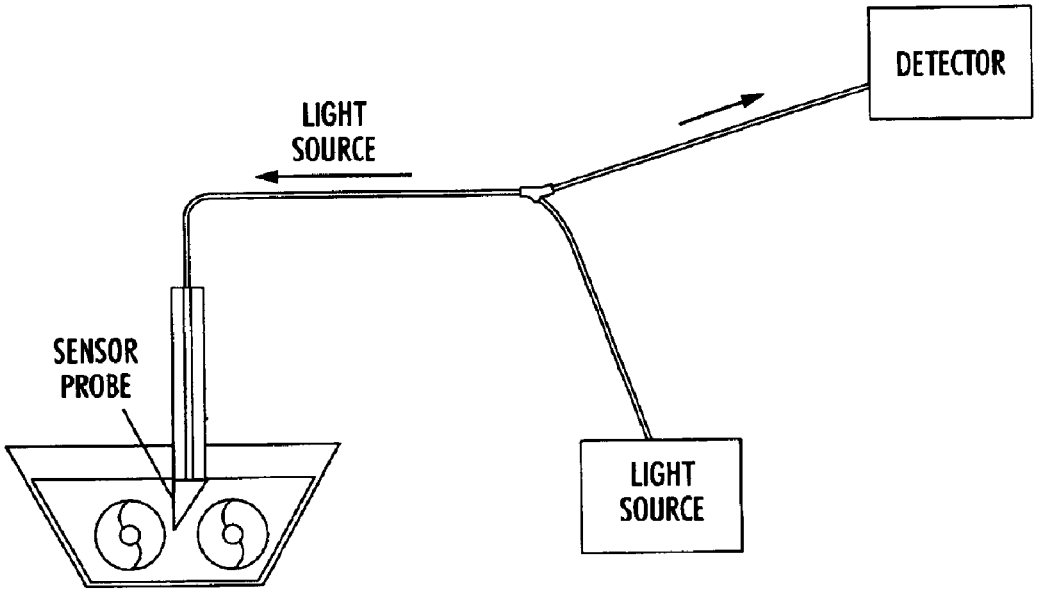
FIG. 3 is a schematic of a second embodiment using the method of the present invention.

Referring to FIG. 3, the basic idea in an optical approach to TC sensing is to infer the TC level in a developer housing by using the fact that the color of the developer changes as a function of TC. In the implementation shown in FIG. 3, the primary sensing components are as follows: 1) Sensor probe consisting of 5 fiber optic cables (collectors) which surround a central fiber optic cable (light source), 2) Light source, and 3) Detector (e.g. spectrophotometer or CCD scanner chip). To measure the color of the developer, the sense head is immersed in the developer sump between the augers (having fresh material "wash" the sensor face helps mitigate filming), and the resulting diffuse signal is routed to a detector, which is then used to compute the color quantity of interest (e.g. E or chroma). Other optical sensor schemes have also been shown to accurately detect the color of the developer as function of TC.

FIG. 4 illustrates a typical response of the optical sensor to changes in TC. In this particular example, a yellow developer was used. Experiments were conducted using 4 developer samples, where each sample was at a specific TC value. For each developer sample, multiple optical measurements were recorded by manually dipping the probe into the sample. Each optical measurement was then transformed into a chroma value and plotted as a function of TC. The results show a chroma-to-TC sensitivity, ΔC'/ΔTC=7.9. Given a calibrated optical sensor, TC is then computed as shown below in Eq. (1).

$$TC_{meas} = \frac{1}{\Delta C'/\Delta TC}(C'_{meas} - C'_0) + TC_0, \tag{1}$$

where $C'_{meas}$ is the measured chroma value and the pair $C_0$, $TC_0$ are the initial chroma and TC values, respectively, determined at calibration.

As it turns out, chroma may not be the color quantity of interest for the other separations. For instance, in black developers L* may be a more suitable metric. Choosing the appropriate color metric is based on signal-to-noise optimization, which, in the case of yellow developers, turned out to be chroma.

As it turns out, optical approaches to sensing TC are also sensitive to changes in developer besides TC. Since we use changes in the optical response of the sensor to infer the level of TC, any noise factors that cause color changes in the developer will be interpreted as changes in TC, which, in turn, leads to a TC sensing error. It has been established that the level of toner impaction on the carrier was found to be the most significant noise factor in the optical approach to TC sensing given above. The reason this is the case is as follows. Nominal carrier beads tend to be gray; therefore, the color of the developer shifts from gray to the color of the toner as the TC level increases. When toner impacts on the carrier, the color of the developer changes without the TC level of the developer changing.

Figure 5:
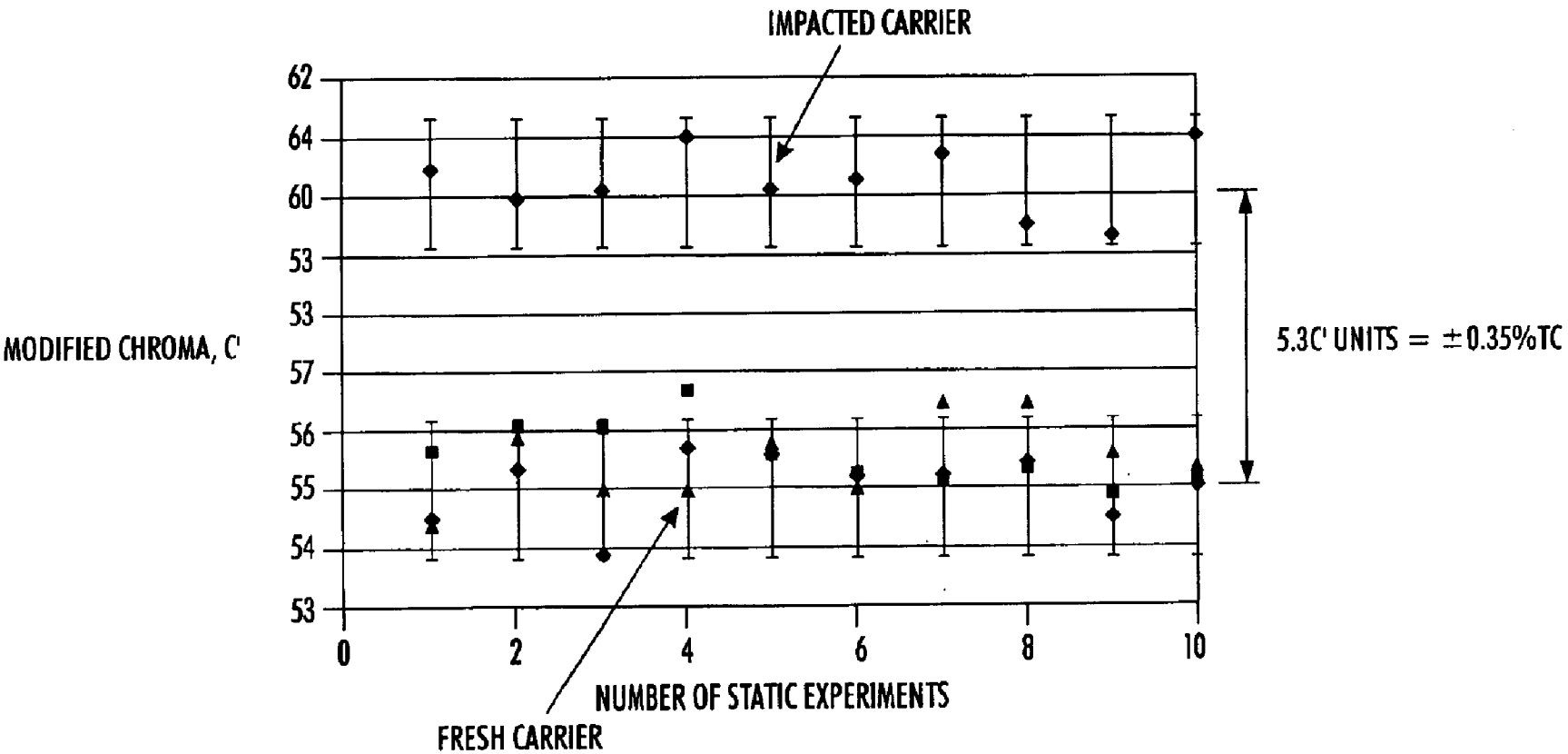
FIG. 5 illustrates the effect of impaction on the optical response of the sensor for a sample Y6 yellow developer.

FIG. 5 illustrates the effect of impaction on the optical response of the sensor for a sample Y6 yellow developer. Experiments were conducted using fresh developer samples and a highly impacted developer sample. The fresh developer samples had impaction values of approximately 0.4 mg/g, and the highly impacted sample had an impaction value of 4.0 mg/g which corresponds to the impaction observed in a developer with approximately 300,000 prints. For each developer sample, multiple optical measurements were recorded by manually dipping the probe into the sample. Each optical measurement was then transformed into a chroma value. As shown in the plot, the mean chroma value of the impacted developer sample is 5.3 chroma units larger than the mean chroma value for the fresh developer sample. This means that if the optical sensor were to measure different yellow developers each having the same TC level but with varying amounts of impaction, then the sensed TC values could vary ±0.35%

$$\left(TC\ Variation = \frac{C'\,Variation}{\Delta C'/\Delta TC'} = 5.3/7.9 = \pm 0.35\,\%\right).$$

Given a TC sensing accuracy requirement of ±0.50%, a sensing error of this magnitude is clearly significant.

Figure 6:
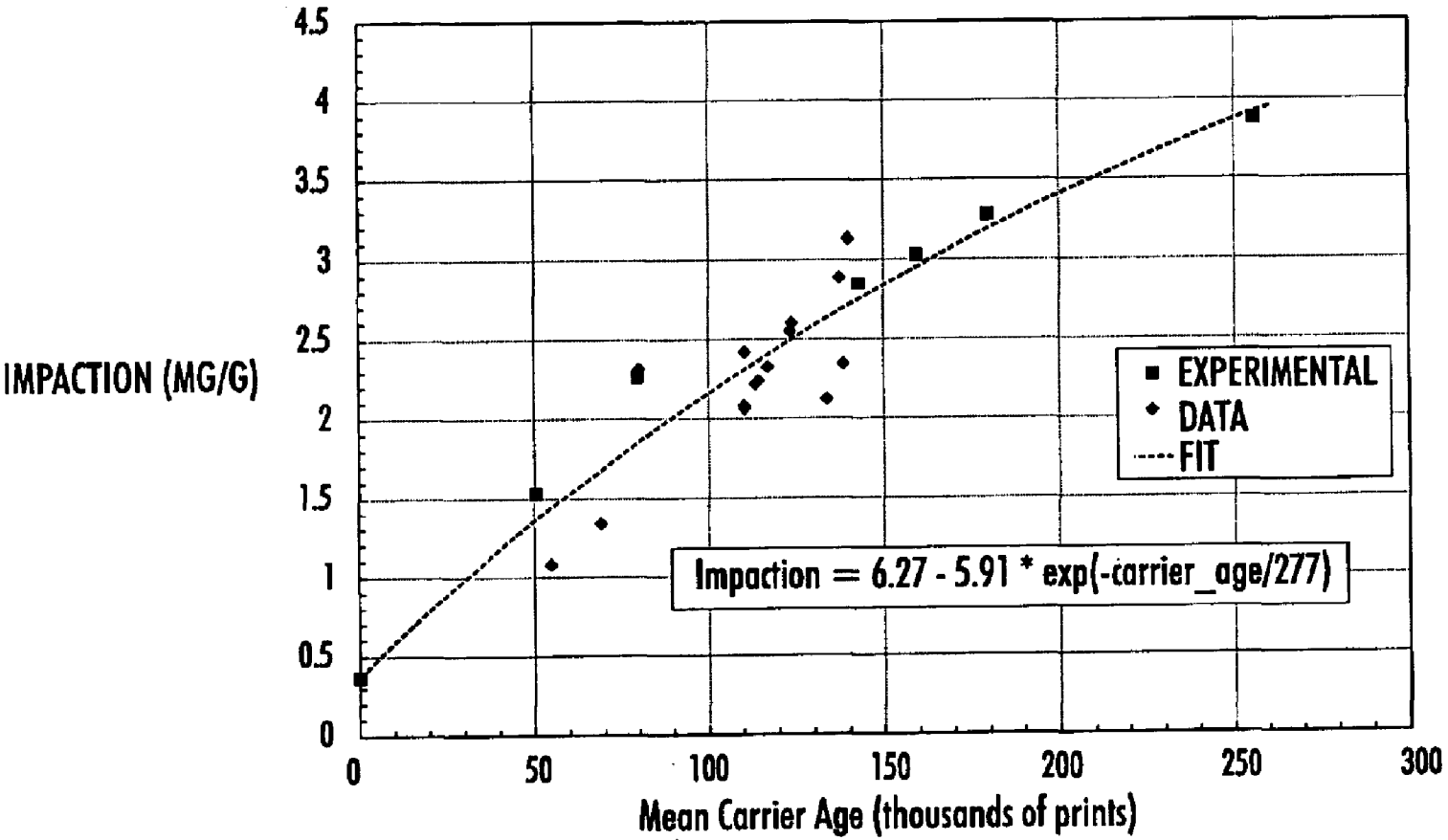
FIG. 6 illustrates the effect of impaction on optical TC sensor response.

FIG. 6 illustrates the effect of impaction on optical TC sensor response (also shown in this figure is the effects of different levels of toner fines on the sensor response. As shown in the figure, the level of toner fines is not a statistically significant noise factor).

To account for the effect of impaction, it is proposed that the measured TC value given in Eq. (1) be corrected as follows:

$$\overline{TC}_{meas}(k)=TC_{meas}(k)+\delta(k), \quad (2)$$

where k is the measurement index, δ is the correction factor, $\overline{TC}_{meas}$ is the corrected TC value, and $TC_{meas}$ is the measured TC value computed from Eq. (1). The correction factor, δ, is computed as $$\delta(k)=\alpha(I(k)-I_0), \quad (3)$$

where α is the correction gain (in units of % TC/(mg/g)), I refers to the level of impaction (mg/g), and $I_0$ is the level of impaction in fresh developer (mg/g). The data in FIG. 5 suggests that α=−0.19(=0.7/(0.4−4)). Below we describe how to estimate I(k).

A characterization study on an IGEN 3™ machine produced by Xerox Corporation suggested that impaction for yellow developer is exponential in carrier age as shown in FIG. 6. Using this data, the following model was constructed to estimate impaction as a function of carrier age for this reduction to practice.

$$I(k)=\theta_1-\theta_2 \exp(-CA(k)/\theta_3), \quad (4)$$

where CA is the carrier age and the model parameters, $\theta_1$, $\theta_2$, and $\theta_3$, were computed to be 6.27, 5.91, and 227, respectively. This model is plotted in FIG. 4.

Carrier age, in turn, is already used in other Xerographic Process Control algorithms and is estimated as follows:

$$CA(k)=(1-\gamma)(CA(k-1)+T), \quad (5)$$

where T is the TC sampling time and γ∈(0,1) is the fraction of carrier mass that is "trickled" out of the housing at each sample time.

At each sample time, denoted by k, the correction algorithm then proceeds as follows:

1. Compute the measured TC value according to Eq. (1).
2. Update the estimate of carrier age using Eq. (5).
3. Update the estimate for impaction using Eq. (4).
4. Compute the correction factor using Eq. (3).
5. Compute the corrected TC value using Eq. (2).

Here we have illustrated an impaction correction algorithm for yellow developer, which results in a reduction in impaction-based TC sensing errors by >factor 2 (±0.15% TC). While the functional form of the algorithm may be similar for other separations, we do not expect the coefficients to be the same for all separations. To compute the coefficients needed for the other separations, additional experiments are needed.

It is, therefore, apparent that there has been provided in accordance with the present invention, that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method for sensing toner concentration in a developer housing with an optical system containing developer material comprising toner and carrier, the method, comprising:

emitting light with the optical system through a viewing window in the developer housing onto developer material in said housing;

sensing the light reflected off said developer material with the optical system;

calculating a toner concentration measurement based upon the sensed light reflected off said developer material; and compensating the toner concentration measurement to account for optical variation due to the developer material condition; said compensation includes determining a carrier age of the developer material; and correlating the carrier age to a carrier age correction factor.

2. The method of claim 1, wherein said compensating includes determining an impaction of the developer material; and correlating the impaction to an impaction correction factor.

3. The method of claim 1, wherein said compensating includes determining a carrier age of the developer material; correlating the carrier age to a carrier age correction factor; determining an impaction of the developer material; and correlating the impaction to an impaction correction factor.

4. A method for sensing toner concentration in a developer housing with an optical system containing developer material comprising toner and carrier, the method, comprising:

emitting light with the optical system through a viewing window in the developer housing onto developer material in said housing;

sensing the light reflected off said developer material with the optical system;

calculating a toner concentration measurement based upon the sensed light reflected off said developer material; and compensating the toner concentration measurement to account for optical variation due to the developer material condition;

said compensating includes determining a carrier age of the developer material; correlating the carrier age to a carrier age correction factor; determining an impaction of the developer material; and correlating the impaction to an impaction correction factor, said calculating includes determining toner concentration with the following equation $$TC_{meas}=\frac{1}{\Delta C'/\Delta TC}(C'_{meas}-C'_0)+TC_0$$

where TC is toner concentration; $C'_{meas}$ is the measured chroma value and the pair $C_0$, $TC_0$ are the initial chroma and TC values, respectively, determined at calibration.

5. The method of claim 4, wherein said determining includes calculating effects of impaction, with the following equation:

$$\overline{TC}_{meas}(k)=TC_{meas}(k)+\delta(k),$$

where k is the measurement index, δ is the correction factor, $\overline{TC}_{meas}$ is the corrected TC value, and $TC_{meas}$ is the measured TC value, said correction factor, δ, is computed as $$\delta(k)=\alpha(I(k)-I_0),$$

where α is the correction gain (in units of % TC/(mg/g)), I refers to the level of impaction (mg/g), and $I_0$ is the level of impaction in fresh developer (mg/g).

6. The method of claim 5, wherein said determining includes calculating effects of carrier age with the following equation:

$$I(k)=\theta_1-\theta_2 \exp(-CA(k)/\theta_3),$$

where CA is the carrier age and the model parameters, $\theta_1$, $\theta_2$, and $\theta_3$.

7. The method of claim 6, further comprising determining carrier age with the following equation:

$$CA(k)=(1-\gamma)(CA(k-1)+T),$$

where T is the TC sampling time and γ is the fraction of carrier mass that is "trickled" out of the housing at each sample time, at each sample time, denoted by k.

8. In an electrographic printing having a method for sensing toner concentration in a developer housing with an optical system containing developer material comprising toner and carrier, the method, comprising:

emitting light with the optical system through a viewing window in the developer housing onto developer material in said housing;

sensing the light reflected off said developer material with the optical system;

calculating a toner concentration measurement based upon the sensed light reflected off said developer material; and compensating the toner concentration measurement to account for optical variation due to the developer material condition;

said compensating includes determining a carrier age of the developer material; correlating the carrier age to a carrier age correction factor; determining an impaction of the developer material; and correlating the impaction to an impaction correction factor said calculating includes determining toner concentration with the following equation:

$$TC_{meas} = \frac{1}{\Delta C'/\Delta TC}(C'_{meas} - C'_0) + TC_0$$

where TC is toner concentration; $C'_{meas}$ is the measured chroma value and the pair $C_0$, $TC_0$ are the initial chrome and TC values, respectively, determined at calibration.

9. In an electrographic printing having the method of claim 8, wherein said compensating includes determining a carrier age of the developer material; and correlating the carrier age to a carrier age correction factor.

10. In an electrographic printing having the method of claim 8, wherein said compensating includes determining an impaction of the developer material; and correlating the impaction to an impaction correction factor.

11. The method of claim 8, wherein said determining includes calculating effects of impaction, with the following equation:

$$\overline{TC}_{meas}(k)=TC_{meas}(k)+\delta(k),$$

where k is the measurement index, δ is the correction factor, $\overline{TC}_{meas}$ is the corrected TC value, and $TC_{meas}$ is the measured TC value, said correction factor, δ, is computed as $$\delta(k)=\alpha(I(k)-I_0),$$

where α is the correction gain (in units of % TC/(mg/g)), I refers to the level of impaction (mg/g), and $I_0$ is the level of impaction in fresh developer (mg/g).

12. The method of claim 11, wherein said determining includes calculating effects of toner age with the following equation:

$$I(k)=\theta_1-\theta_2\exp(-CA(k)/\theta_3),$$

where CA is the carrier age and the model parameters, $\theta_1$, $\theta_2$, and $\theta_3$.

13. The method of claim 12, further comprising determining carrier age with the following equation:

$$CA(k)=(1-\gamma)(CA(k-1)+T),$$

where T is the TC sampling time and γ is the fraction of carrier mass that is "trickled" out of the housing at each sample time, at each sample time, denoted by k.

* * * * *